US011723471B2

(12) United States Patent
Rajaratnam

(10) Patent No.: US 11,723,471 B2
(45) Date of Patent: Aug. 15, 2023

(54) SEAT BACK SUPPORT

(71) Applicant: Kumar Rajaratnam, Ewingsdale (AU)

(72) Inventor: Kumar Rajaratnam, Ewingsdale (AU)

(73) Assignee: Kumar Rajaratnam, Ewingsdale (AU)

( * ) Notice: Subject to any disclaimer, the term of this patent is extended or adjusted under 35 U.S.C. 154(b) by 0 days.

(21) Appl. No.: 17/274,983

(22) PCT Filed: Jun. 28, 2019

(86) PCT No.: PCT/AU2019/050685

§ 371 (c)(1),
(2) Date: Mar. 10, 2021

(87) PCT Pub. No.: WO2020/051626

PCT Pub. Date: Mar. 19, 2020

(65) Prior Publication Data

US 2022/0031075 A1 Feb. 3, 2022

(30) Foreign Application Priority Data

Sep. 11, 2018 (AU) ..... 2018903397

(51) Int. Cl.

| | |
|---|---|
| ***A47C 7/28*** | (2006.01) |
| ***A47C 7/46*** | (2006.01) |
| ***A47C 7/00*** | (2006.01) |
| *A61G 5/12* | (2006.01) |
| *A47C 5/12* | (2006.01) |

(52) U.S. Cl.

CPC ..... *A47C 7/462* (2013.01); *A47C 7/004* (2013.01); *A47C 7/282* (2013.01); *A47C 5/12* (2013.01); *A61G 5/122* (2016.11)

(58) Field of Classification Search

CPC ..... A47C 7/004; A47C 7/282; A47C 7/462; A47C 7/42

USPC ..... 297/230.1, 230.11, 230.12, 230.14, 297/452.64

See application file for complete search history.

(56) References Cited

U.S. PATENT DOCUMENTS 226,475 A * 4/1880 Bell ..... A47C 1/032 297/452.64
2,059,597 A * 11/1936 Okano ..... B60N 2/7005 297/452.43 X
2,076,510 A * 4/1937 Ficks ..... A47C 5/02 297/452.64

(Continued)

FOREIGN PATENT DOCUMENTS

GB 1423617 A 2/1976
GB 2405580 A 3/2005

OTHER PUBLICATIONS

Notification of Transmittal of the International Search Report and the Written Opinion of the Internatinal Search Authority from corresponding PCT/AU/2019/050685 dated Sep. 4, 2019.

*Primary Examiner* — Rodney B White
(74) *Attorney, Agent, or Firm* — Lando & Anastasi, LLP

(57) ABSTRACT

A seat back support with an adjustable support curvature, the support including: a frame; at least one elongate deformable member extending between side portions of the frame; and an elongate adjustment element that intersects one or more of the at least one deformable member(s), wherein manipulation of the adjustment element adjusts the deformation of the one or more deformable member(s) with which it intersects to adjust the curvature of the back support.

18 Claims, 13 Drawing Sheets

(56) References Cited

U.S. PATENT DOCUMENTS 2,182,253 A * 12/1939 Farrell ..... A47C 7/425 297/230.11
2,354,436 A * 7/1944 Stedman ..... B61D 33/0035 297/452.64 X
2,547,350 A * 4/1951 Veale ..... B60N 2/7005 297/452.64
2,557,269 A * 6/1951 Fox ..... A47C 7/282 297/230.11
2,766,814 A * 10/1956 Sedlacek ..... A47C 7/22 297/452.64
2,830,350 A * 4/1958 Wootton ..... A47C 5/06 297/452.64
2,876,827 A * 3/1959 Mirrione ..... A47C 7/22 297/452.64
2,878,861 A * 3/1959 Molla ..... A47C 7/22 160/DIG. 15
2,934,134 A * 4/1960 Adler ..... A47C 7/22 297/452.64
2,964,099 A * 12/1960 Panicci ..... A47C 1/0265 297/452.64
3,035,866 A * 5/1962 Raduns ..... A47C 7/54 297/452.64
3,086,819 A * 4/1963 Effeny ..... B60N 2/7035 297/452.64
3,094,358 A * 6/1963 Hartman ..... A47C 7/22 297/452.64
3,165,359 A * 1/1965 Ashkouti ..... A47C 7/22 297/452.64
3,170,731 A * 2/1965 Caldemeyer ..... A47C 7/282 297/452.26
3,188,662 A * 6/1965 Watson ..... A47C 20/027 297/452.64
3,258,259 A 6/1966 Bohlin
3,679,261 A * 7/1972 Slabakov ..... A47C 7/425 297/230.11
4,057,291 A * 11/1977 Dubinsky ..... A47C 7/22 297/452.64
4,722,569 A 2/1988 Morgenstern et al.
5,403,067 A * 4/1995 Rajaratnam ..... A61G 5/10 297/230.11
5,624,158 A 4/1997 Adat et al.
5,957,532 A * 9/1999 Watkins ..... A61G 5/1091 297/452.63
6,186,594 B1 2/2001 Valiquette et al.
6,971,717 B1 * 12/2005 Rhodes ..... A47C 7/46 297/230.11
7,651,163 B2 * 1/2010 Jaskot ..... A47C 7/425 297/230.11
8,261,384 B2 * 9/2012 Batiste ..... A47C 7/425 297/230.1 X
8,459,737 B2 * 6/2013 Brotsch ..... A47C 7/425 297/230.11
8,622,472 B2 * 1/2014 Rajaratnam ..... A47C 7/282 297/452.56
11,259,639 B2 * 3/2022 Wilcox ..... A47C 7/624
2002/0145326 A1 * 10/2002 Liu ..... A47C 4/03 297/452.64
2004/0104610 A1 * 6/2004 Jaskot ..... A47C 7/425 297/230.11
2008/0023996 A1 1/2008 Bard
2010/0264708 A1 * 10/2010 Rajaratnam ..... A47C 7/282 297/284.2 X
2011/0298255 A1 * 12/2011 Brotsch ..... A47C 7/425 297/230.1 X
2015/0216311 A1 8/2015 Behar et al.
2017/0112288 A1 4/2017 DuFresne

* cited by examiner

SEAT BACK SUPPORT

CROSS-REFERENCE TO RELATED APPLICATIONS

This application is a U.S. National Phase Application under 35 U.S.C. § 371 of International Application No. PCT/AU2019/050685, filed Jun. 28, 2019, which claims priority to Australian Application No. 2018903397, filed Sep. 11, 2018. Each application referenced above is hereby incorporated by reference in its entirety for all purposes.

FIELD OF THE INVENTION

The present invention relates to adjustable back support for a seat or a chair. The invention particularly relates to seats used in an office environment. The invention may also relate to chairs used in the factory environment and aged care facilities such as retirement homes, as well as wheelchairs.

BACKGROUND

There are various known arrangements and constructions for back supports for seats. Back support is typically to the lumbar region of a back of a user. The back support may be in the form of additional upholstery in the seat back. Alternatively a pad or bladder may be placed in the upholstery to provide lumbar support.

In more recent seat backs the pad or bladder may be adjustable in how much it projects horizontally outwards from the seat back and into the lumbar region of the seat user. However the shape of such pads or bladders does not change, apart from how much it projects outwards from the chair back.

Other seat backs may also be adjustable in vertical height and angle in relation to the seat. Such adjustability may be used to adjust the lumbar support position to an individual user's comfort.

None of these prior art apparatus provides an entirely satisfactory solution to the provision of back support for a seat for individual users. Nor to the ease of construction and adjustability of back support.

SUMMARY OF THE INVENTION

The present invention aims to provide an alternative back support arrangement which overcomes or ameliorates the disadvantages of the prior art, or at least provides a useful choice.

In one form, the invention provides a seat back support comprising: a frame; at least two substantially parallel horizontal bands adjustably secured across the frame; two approximately vertical straps overlaying the horizontal bands; and the vertical straps are secured at either end to the frame; wherein the at least two vertical straps adjust a shape of the at least two horizontal bands to adjust the back support.

In one form, the adjusted shape of the horizontal bands is an isosceles trapezoidal channel. In one form, the horizontal bands includes respective flat portions between the two vertical straps overlaying the horizontal bands. In one form, the adjusted shape of the horizontal bands includes respective sloping sides from a periphery of the frame to the flat portions.

In one form, the back support is adjusted to be conformal and provide support to at least two of a sacral region (hip), a lumbar region (lower back), a thoracic region below the scapulae (middle of the back) and a cervical region including the scapulae (shoulder blades) of a back support user. In one form, the back support is adjusted to be conformal and provide back support to a transverse or lateral section of a back support user.

In one form, the adjusted shape of the horizontal band is adjusted by at least one of a tension in the vertical straps, a tension in the horizontal bands, varying a length of the vertical straps and varying a separation between the respective ends of the vertical straps secured to the frame. In one form, the length of the vertical straps is varied by adjusting a distance between an upper slot in the frame and a bottom slot in the frame used for securing the vertical strap.

In one form, the adjacent horizontal bands are adjusted or constrained in shape by the vertical straps to provide adjacent flattened portions and adjacent sloping sides of a channel of the back support.

In one form, the back support provides an adjustable free space for a user's scapula.

In a further form, the invention provides a back support method as substantially described herein.

In a further broad form, the present invention provides a seat back support with an adjustable support curvature, the support including: a frame; at least one elongate deformable member extending between side portions of the frame; and an elongate adjustment element that intersects one or more of the at least one deformable member(s), wherein manipulation of the adjustment element adjusts the deformation of the one or more deformable member(s) with which it intersects to adjust the curvature of the back support.

In one form, the seat back support includes a plurality of elongate deformable members. In one form, the elongate adjustment element intersects all the elongate deformable members.

In one form, the adjustment element can be manipulated to extend between different points in the frame so as to adjust the amount and/or location of deforming engagement with the deformable member(s).

In one form, the plurality of elongate deformable members do not intersect one another. In one form, the plurality of elongate deformable members are substantially parallel. In one form, the at least one elongate deformable member is at least one band.

In one form, the adjustment element extends between a top portion of the frame, above the at least one deformable element, and a bottom portion of the frame, below the at least one deformable element.

In one form, the seat back support includes a plurality of adjustment elements. In one form, the adjustment element is a strap.

In one form, the at least one elongate deformable member is suspended between the side portions of the frame.

BRIEF DESCRIPTION OF THE DRAWINGS

The description is made with reference to the accompanying drawings, of which.

DETAILED DESCRIPTION

Figure 1:
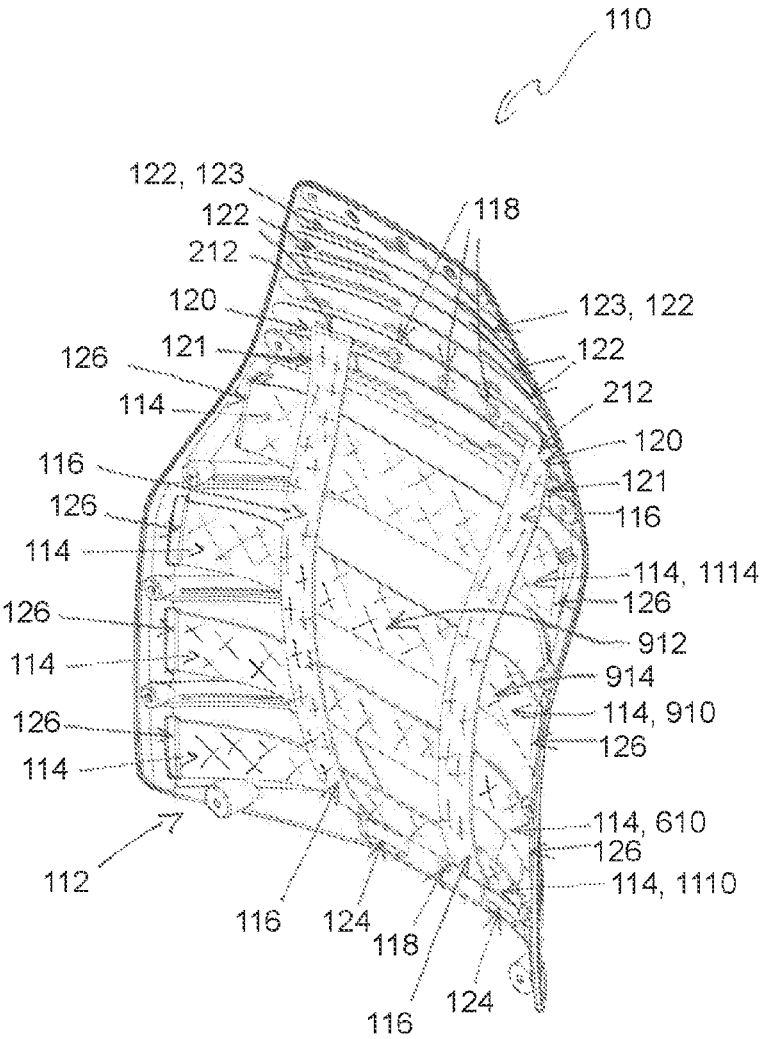
FIG. 1 is a schematic of a front, perspective view of a back support for a seat.

FIG. 1 is a front, perspective view of a back support 110 for a seat (not shown). The back support 110 has a frame 112 that is used to support and secure an arrangement of horizontal bands 114 and two overlaying vertical straps 116. The frame 112 may also be used to support upholstery as described further below with respect to FIGS. 12 and 13. The frame 112 may be attached to the rest of the seat or chair structure by a T-Brace (not shown) or "cage" attached to the frame 112 at a number of brace fixture points 118 at the top and bottom of the frame 112. The T-Brace may also serve to stiffen the frame 112 vertically or longitudinally so that the frame does not flex or otherwise bend. Further stiffening to the frame 112 to improve rigidity may be applied as necessary as described below with respect to FIGS. 3 to 5.

The frame 112 may be made of an engineering plastic or other lightweight material, such as a composite, so that it does not substantially flex or otherwise distort in use and under tension from the horizontal bands 114 and the vertical straps 116.

The frame 112 has a concave shape to the front view shown which is to the seat user's back. The frame's concave shape allows for the horizontal bands 114 and vertical straps 116 to be tensioned and suspended away from the frame 112 in order to provide a region of back support to the user. The horizontal bands 114 and the vertical straps 116 may be made of a suitably elastic material so that they are easily tensioned in the rigid frame 112. For example the horizontal bands 114 may be made of a polymer rubber composite. The vertical straps 116 may be made of a polyester, nylon and/or cotton with an elastic material. The horizontal bands 114 and the vertical straps 116 are also elastic so that they provide an elastically yielding support to the seat user as the user leans into the back support 110. It was found that it was generally preferred that the horizontal bands be broader than the vertical straps. For example the width of the horizontal bands may be in the approximate range of 30 to 70 mm. The width of the vertical straps 116 may be in the approximate range of 10 to 40 mm. In addition it was also generally preferred that the vertical straps be more elastic than the horizontal bands. For example the horizontal bands 114 may be elastically stretched from approximately 80 to 100% greater than their resting or no tension length. The vertical straps 116 may be elastically stretched from approximately 80 to 200% greater than their resting or no tension length.

The arrangement of the horizontal bands 114 and the two overlaying vertical straps 116 shown in FIG. 1 and the other FIGURES is an arrangement where the overlaying vertical straps 116 are approximately orthogonal to the horizontal bands. In addition the vertical straps are approximately vertical. An example of such approximate verticality and orthogonality is given in FIG. 11 described below as well as during the description of the invention herein.

The two vertical straps 114 at their upper respective ends may be secured to the frame 112 via respective upper slots 120 in the frame 112 as shown. Further upper slots 122, as shown in FIG. 1, may alternatively be used to secure the upper ends 310 of the vertical straps 116 to change the shape of the back support region as described further below. The other, lower end 312 of the vertical straps 114 may be secured to the frame 112 by respective bottom slots or apertures 124 as shown.

Figure 2:
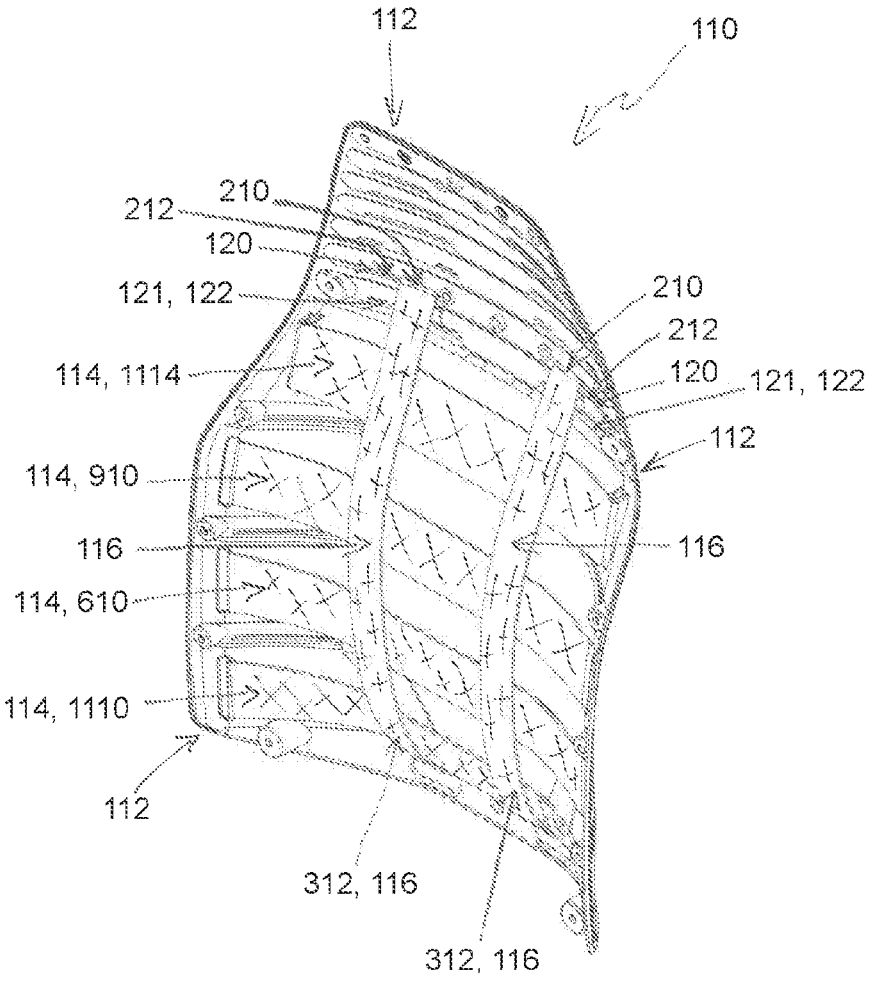
FIG. 2 is a schematic of an alternate arrangement of the vertical straps in FIG. 1.

FIG. 2 shows an alternate arrangement of the vertical straps 116 to FIG. 1. In FIG. 2 the upper ends of the vertical straps 116 in the upper slot 120 are shown at an inner extent 210 of the slot 120 so that the vertical straps 116 are closer together. In comparison the vertical straps 116 are shown to an outer extent 212 of the slot 120 in FIG. 1 so that the vertical straps 116 are separated further apart. In a similar fashion the bottom slots 124 for the lower ends of the vertical straps 116 may also be elongated so that the vertical straps ends at the bottom of the frame 112 may be varied in how much they are spaced or separated apart.

Figure 3:
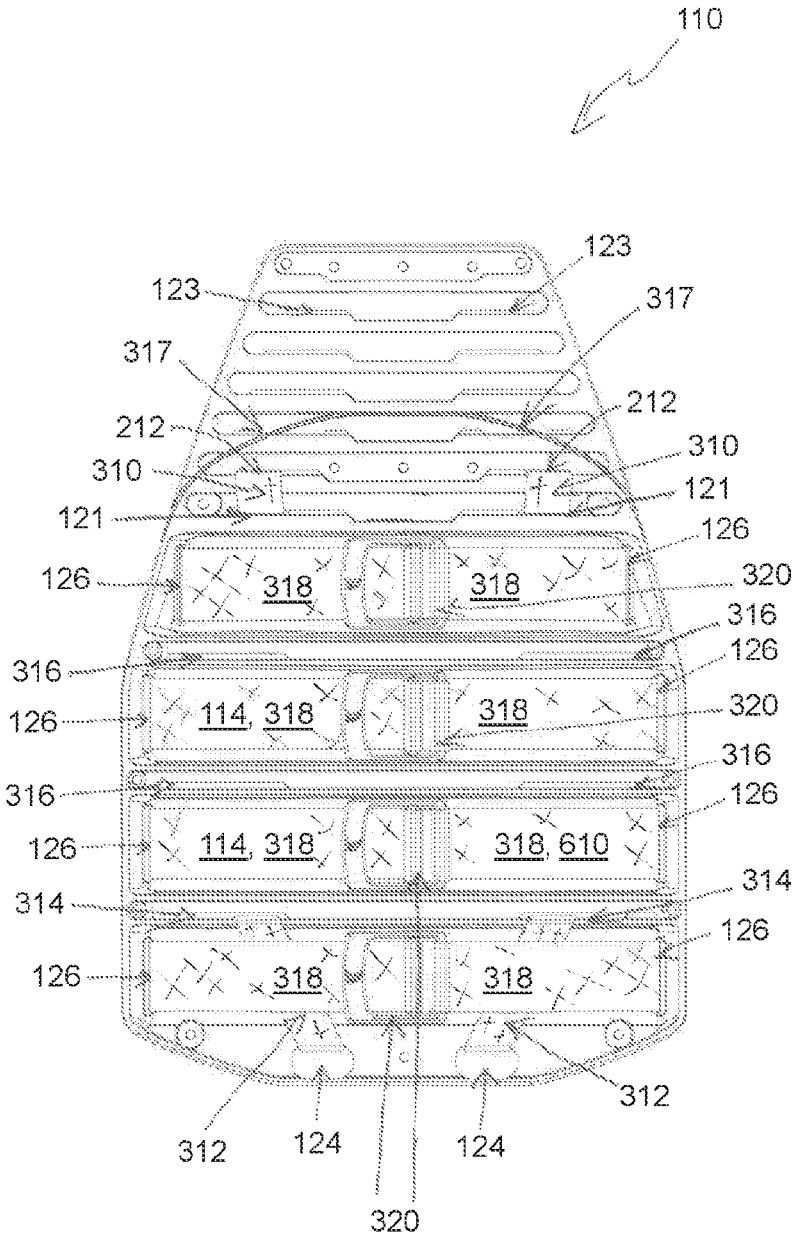
FIGS. 3 and 4 are schematics to respective rear elevational and rear perspective views of the back support in FIG. 1.
Figure 4:
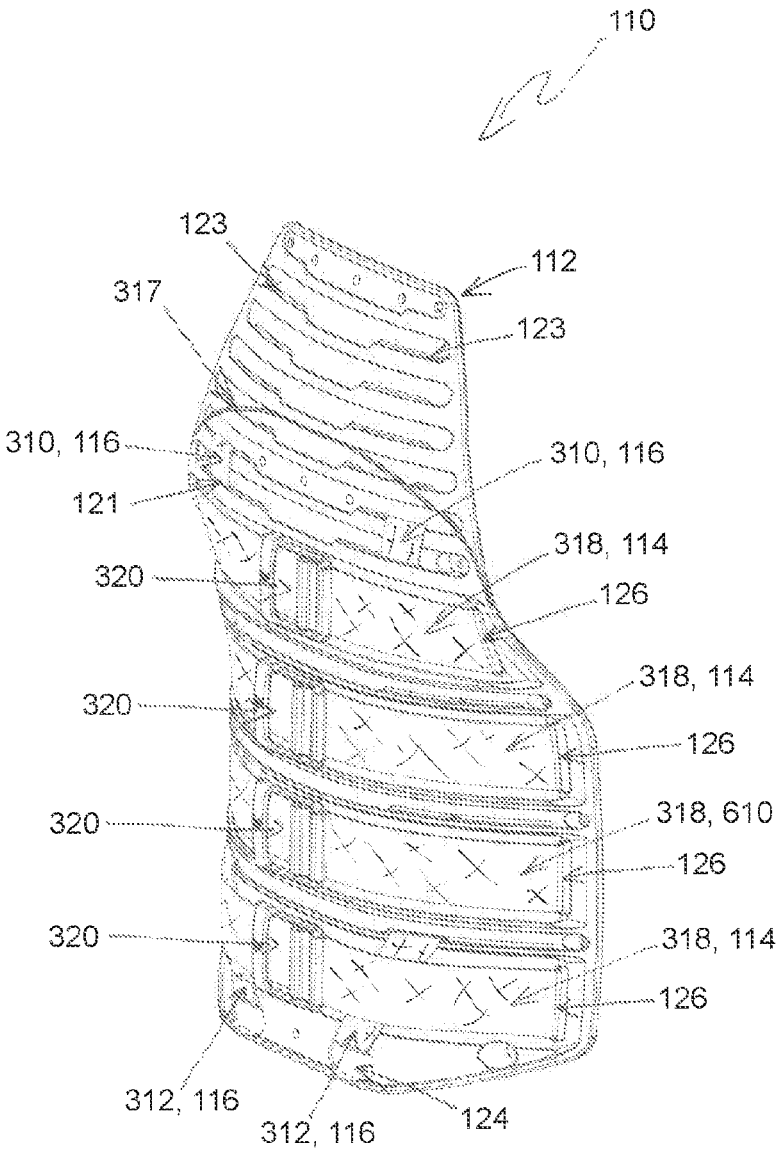

FIGS. 3 and 4 are respective rear elevational and rear perspective views of the back support 110. The upper end 310 of each respective vertical strap 116 is shown secured in an adjacent further, upper slot 121. The lower end 312 of each respective strap is shown secured to a respective, adjacent lower slot 314 to the bottom slot/aperture 124. The use of the adjacent slots 121, 314 may allow for the strap tension to be adjusted as readily designed by a person skilled in the art for strap securing and tensioning arrangements.

Further lower slots 316 are shown in FIGS. 3 and 4. These further lower slots 316 may also be used for adjusting the vertical strap tension. The further lower slots 316 and the adjacent lower slot 314 may also be used as alternatives to the bottom slot 124 for securing the lower ends 312 of the two vertical straps 116. The alternative slots 314, 316 to the bottom slot 124 may be used to alternatively secure the lower ends 312 of the vertical straps 116 to also change the shape of the back support region as described further below.

In FIG. 1 vertical slots 126 are shown in a periphery of the frame 112. The vertical slots 126 may be used to secure the horizontal bands 114 to the frame 112 as described further below. The vertical slots 126 and the horizontal bands 114 are generally located on the back support 110 frame 112 to correspond to the regions of the user's back of: a sacral region (hip), a lumbar region (lower back), a thoracic region below the scapulae (middle of the back) and a cervical region including the scapulae (shoulder blades). It will be readily appreciated that seat users may vary considerably in size or stature and build such that the various regions of multiple users back, from the sacral to the cervical, may vary to where they rest against for a particular backrest. Accordingly the four, substantially parallel horizontal bands 114 shown in the FIGURES are not intended to correspond directly to each of the user's back regions detailed above, rather the horizontal bands 114 with the vertical straps 116 provide a back support region that may be varied and adjusted to accommodate a wide variety of users for back support for their individual back regions from the sacral to the cervical as described herein. Alternatively or in addition the back support 110 height with respect to the seat may be adjusted to vary the position of the horizontal bands 114 with respect to the various regions of the user's back. The back support 110 height may be adjusted with a ratchet mechanism attached to the T-Brace as described further below.

Figure 5:
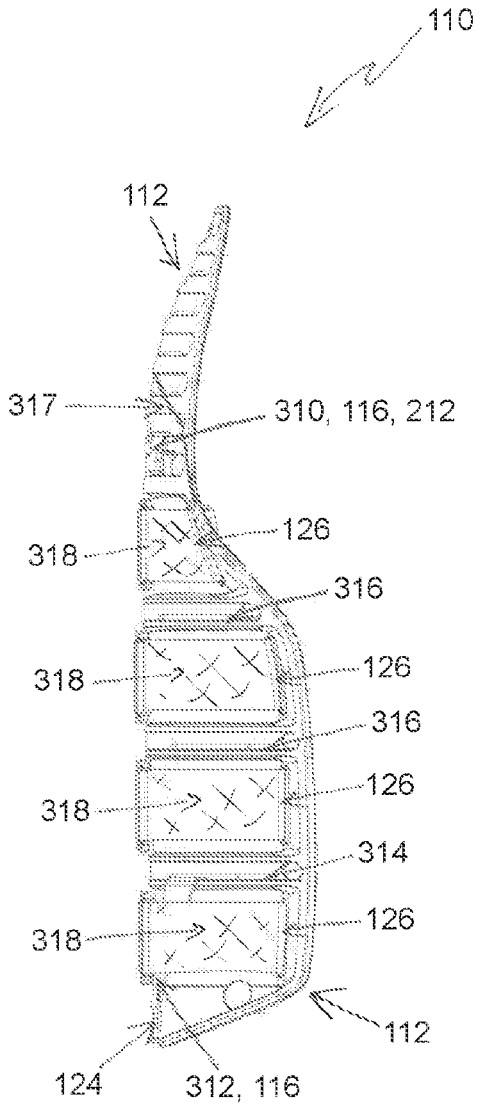
FIG. 5 is a schematic of a side elevational view of the back support of FIG. 1.

Further to accommodating a wide range of users, the frame 112 may be produced in high back and low backed versions. FIGS. 3 to 5 show a parting or separation line 317 on the frame 112 to allow the separation of the further upper slots 122 from the rest of the frame to produce a low backed version of the back support 110. A low backed version may be used for smaller users requiring less horizontal bands or larger users preferring no support at the shoulder blades (scapulae and cervical region).

In another alternative the extent of the back regions from the sacral to cervical for user subpopulations may be used to scale the back support 110. For example to scale the back support size for school children, teenagers, aged care users and wheelchair users.

In FIGS. 3 and 4 the respective ends 318 of the horizontal bands 114 which have been passed through the vertical slots 126 are shown secured together at the rear of the frame 112. The ends 318 may be adjustably secured 320 by a hook and loop fabric fastener (e.g. Velcro) or an adjustable buckle device 320 for example. Using an adjustable securing 320 of each horizontal band 114 allows adjustment of the tension in each horizontal band 114.

FIG. 5 is a side elevational view of the back support 110. FIG. 5 more clearly shows the vertical slots 126 and an alternate view of the adjustable securing buckle 320 for the horizontal bands 114. Also shown are the lower slots 314, 316 that may be used to alternatively secure the lower ends 312 of the vertical straps 116.

The rigidity of the frame 112 may be further improved by the addition of transverse stiffening bands (not shown) secured to the frame 112 corresponding to the areas under the ends 318 of the horizontal bands 114. The transverse stiffening bands (not shown) may extend transversely across the rear or front face of the frame towards respective, opposing vertical slots 124 for a horizontal band 114. The transverse stiffening bands may also be attached to the T-Brace or cage to further improve the rigidity of the frame 112. It will be readily apparent from the description herein to the back support 110 that the frame 112 needs to be substantially rigid for the back support arrangement of the vertical straps 116 overlaying the horizontal bands 114 to work. In addition the transverse stiffening bands may be attached to the frame 112 shortly after injection moulding production in order to maintain the desired frame concave shape as the frame 112 cools. Furthermore during freight of the frames 122 to final assembly elsewhere in the world, the stiffening bands may aid to maintain the shape specification of the frame 112 if the freighted frames are subjected to extreme temperatures during freight.

Figure 6:
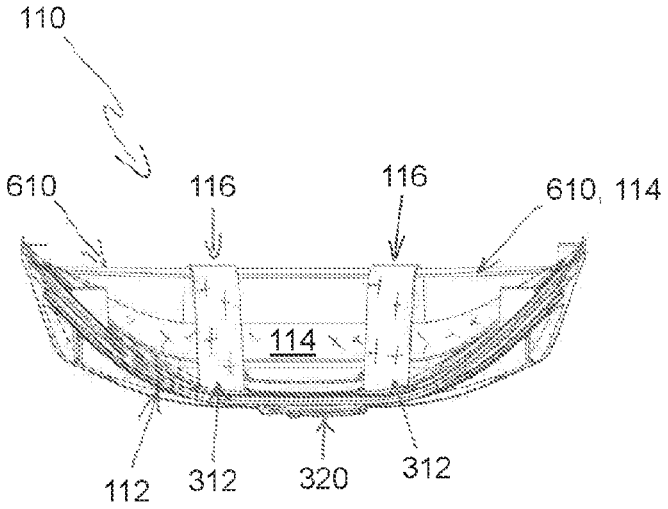
FIGS. 6 to 8 are schematics to end elevational views of the back support looking from the bottom of the frame to the top.
Figure 7:
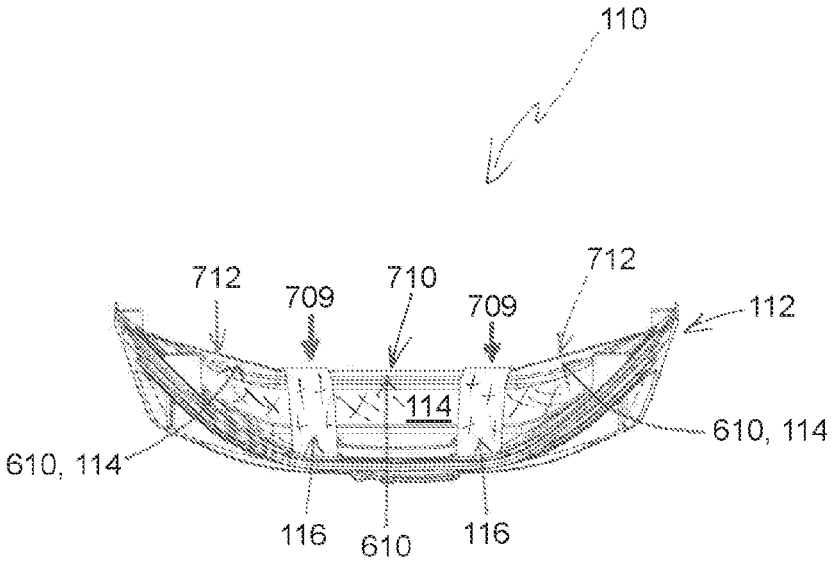
Figure 8:
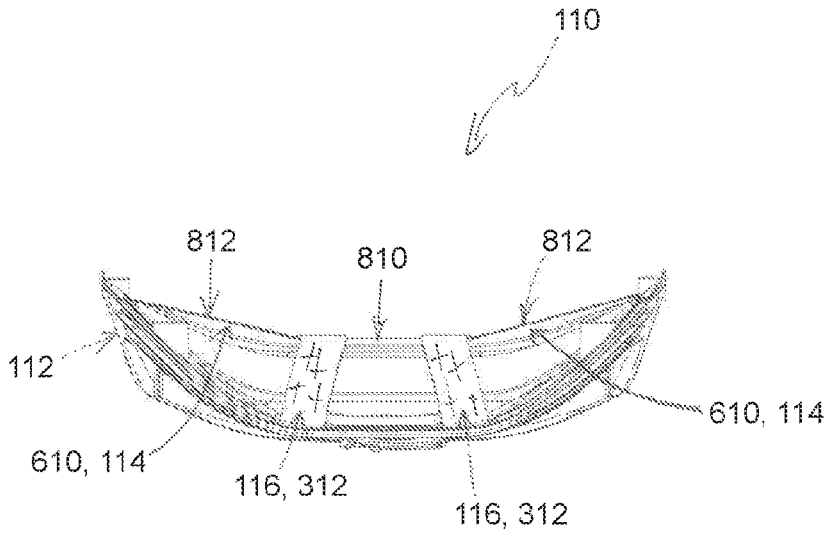

FIGS. 6 to 8 are end elevational views of the back support 110 looking from the bottom of the frame 112 to the top.

Figure 9:
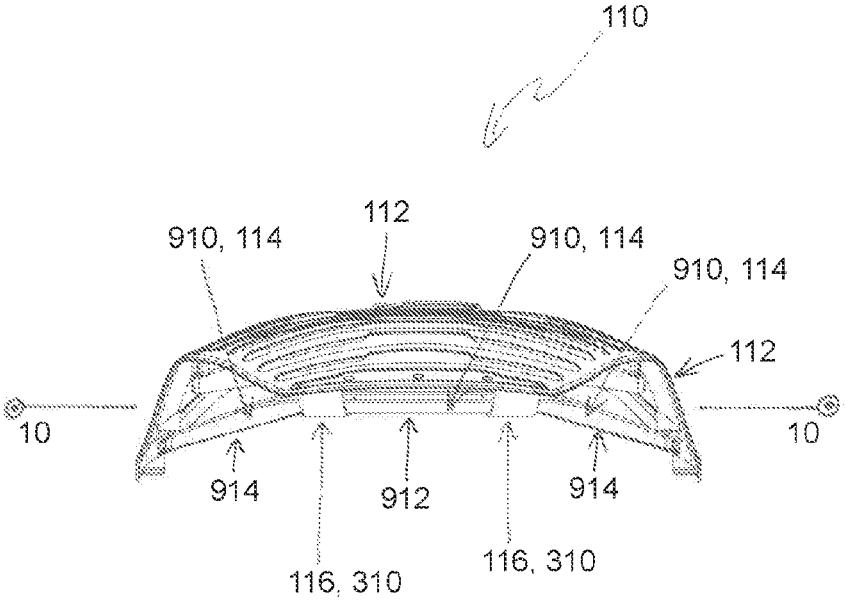
FIG. 9 is a schematic of an opposing end, elevational view of FIG. 7 or 8 that is looking from the top of the frame downwards.

FIG. 9 is an opposing end, elevational view of FIG. 7 or 8 that is looking from the top of the frame 112 downwards.

FIG. 6 shows the second lowermost (or third from the top) horizontal band 610 tensioned with the overlaying vertical straps 116 not appreciably tensioned or slack. The horizontal band 610 as shown in FIG. 6 may provide a flat support surface to a user which is typical in the prior art.

FIG. 7 shows the change in shape of the second lowermost horizontal band 610 when tension is applied to the vertical straps 116. The vertical straps 116 pull the horizontal band 610 in towards the concave or front face of the frame 112 as shown by the arrows 709. The horizontal band's 610 longitudinal shape is now in the form of a channel with a flat portion 710 between the vertical straps 116 and sloping sides 712 from each vertical strap intersection, to the periphery of the frame 112. In other words the horizontal band 610 has formed a channel of three sides of an isosceles trapezoid, with the sloping sides 712 of the horizontal band 610 corresponding to the sides or legs of the isosceles trapezoid and the flat portion 710 corresponding to the smaller base of the isosceles trapezoid.

FIG. 8 shows the horizontal band 610 varied in shape by moving the vertical straps 116 to the inner extent 210 of the upper slot 120 as shown in FIG. 2 and in the front elevational view in FIG. 11, described below. In FIG. 8 the horizontal band 610 has a narrower flat portion 810 and may have shallower angled sides 812. This is in contrast to the horizontal band 610 shape 710, 712 shown in FIG. 7 of a broader flat portion 710 and sides 712 that may be more steeply angled. The horizontal band 610 shape shown in FIG. 7 was with the vertical straps 116 to the outer extent 212 of the upper slot 120 as shown in FIG. 1.

In FIG. 9 the elevational view from the top of the frame 112 shows the second top horizontal band 910 also formed into a channel or isosceles trapezoid by the overlaying vertical straps 116. The second top horizontal band 910 also features a flat portion 912 between the vertical straps 116 and relatively shallow sloping sides 914 when compared with the horizontal band 610 in FIGS. 7 and 8.

Figure 10:
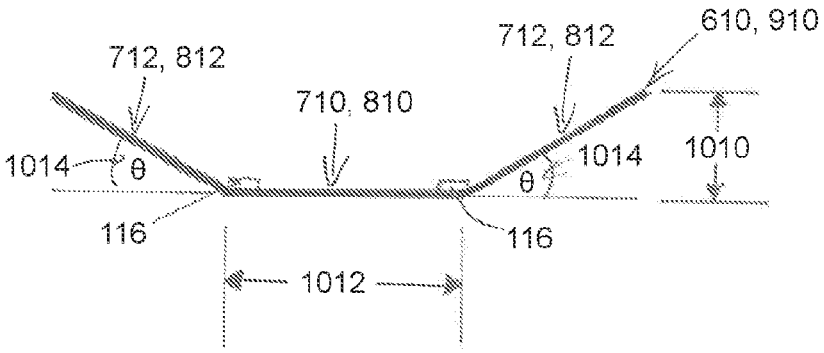
FIG. 10 is a schematic of a longitudinal sectional view of the horizontal bands shown along lines 10-10 of FIGS. 9 and 11.

FIG. 10 is a schematic of a longitudinal sectional view of the horizontal bands 610, 910 of FIGS. 7 to 9 but omitting the frame and other horizontal bands in order to improve clarity. The longitudinal section of FIG. 10 is shown along lines 10-10 of FIGS. 9 and 11. The channel shape that may be formed in the horizontal bands may be varied in a channel depth 1010, a width 1012 of the flat portion 710, 810 and an angle theta θ 1014 of the sloping side 712, 812 to a plane of the front face of the back support 110. The dimensions of the channel formed and the angle of the sloping sides of a horizontal band may be changed by varying the absolute and relative tensions in the horizontal band 114, 610, 910 and the two vertical straps 116. In addition, changing the selection of the positioning of the upper and lower ends 210, 212 of the two vertical straps in the multiple upper slots 120, 122 and the lower and bottom slots 124, 314 may also be used to vary the dimensions of the channel and the angle of the sloping sides of at least one horizontal band, further described below. Also as described above the vertical straps 116 ends 310, 312 may be moved transversely in a slot to also vary the shape of at least one horizontal bands.

Figure 11:
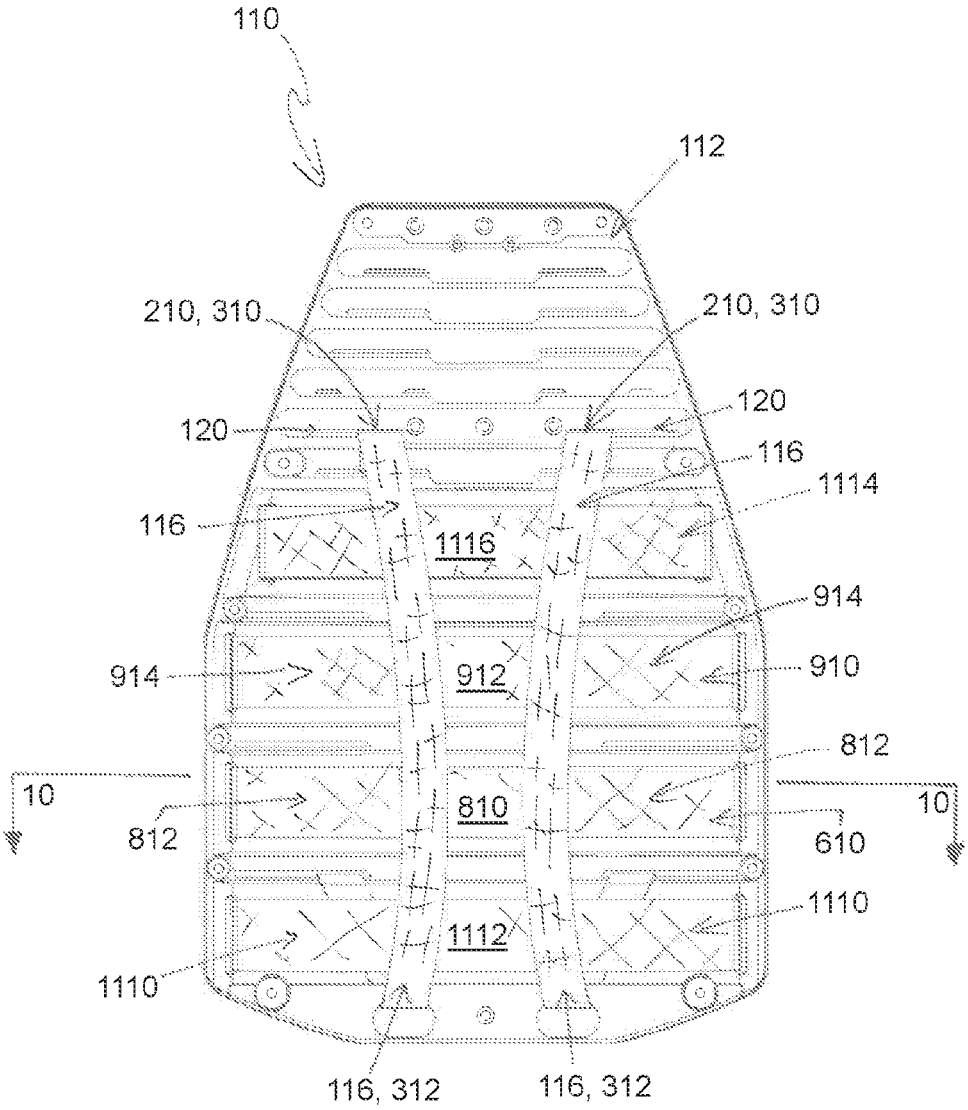
FIG. 11 is a schematic of a front elevational view of FIG. 8.

FIG. 11 is a front elevational view of FIG. 8 where the upper ends 310 of the vertical straps are secured and tensioned in the upper slots 120 to the innermost extent 210 of the slot. The variation between the flat portions width 1012 of each horizontal band 114, 610, 910 between the vertical straps 116 is readily seen. The second 910 and third 610 horizontal bands from the top of the frame 112 have the narrowest flat portion 810, 912 widths 1012. The bottom horizontal band 1110 has comparatively, in this example, a larger flat portion 1112 than the second and third horizontal bands 910, 610. The topmost horizontal band 1114 has the largest, in this example, flat portion 1116 compared with the other horizontal bands 910, 610, 1110 restrained by the two vertical straps 116.

Varying the width 1012 of the flat portion 710, 810, 912, 1012, 1116 may be used to provide a back support with a channel that has a generally broad flattened portion up the back support to suit a broad, muscular back of a man. Alternatively a generally narrow width 1012 flat portion may be produced to suit a small stature and narrower back of say a woman.

As described with respect to FIGS. 1 to 4 varying the positioning of the upper and lower ends 310, 312 of the vertical straps in the multiple slots 120, 122, 124, 314, 316 in the frame 112 may be used to vary the curvature of the back support across the horizontal bands 114. For example securing the ends of the vertical straps in the slots 121, 124 immediately adjacent to the topmost and bottommost horizontal bands 1114, 1110 may be used to produce a low radius of curvature for the back support. That is the back support arrangement projects outwards prominently. In contrast if the slots 123, 124 which are at the top and bottom periphery of the frame are selected to secure the ends 310, 312 of the vertical straps 116 then a comparatively high radius of curvature may be produced. That is the back support arrangement projects comparatively less and is broader in the vertical direction. It will be readily appreciated that varying the tensions of the horizontal bands 114 will also change how much the back support arrangement projects from the frame as well as the stiffness of the support provided to the user's back at various regions of the back.

In a similar fashion the radius of curvature in the vertical plane of an individual horizontal band may varied by adjusting the position and tension of the vertical straps 116. FIGS. 7 to 9 show the curvature transversely across the uppermost horizontal bands 610, 910 as imparted by the vertical straps 116 in each respective figure.

The vertical straps 116 may be used to vary the shape of the multiple the horizontal band arrangement as described herein and shown in the FIGURES. In addition the vertical straps 116 overlaying or constraining the horizontal band arrangement provide a continuous curve across the horizontal bands to produce a continuous channel of support to the user's back without discontinuity. In other words the two vertical straps 116 smooth or modulate the individual horizontal bands to provide a smooth, continuous back support.

FIGS. 1 and 2 with the alternate views of FIGS. 7 to 9 and 11, show examples of the continuous conformal shaping to a user's back that may be produced by the back support 110. Furthermore this continuous, shaped back support 110 is adjustable to vary the support and vary the shape by varying the tensions and positions of the horizontal bands and vertical straps secured to the frame. The overlaying vertical bands 116 to the horizontal bands 114 ensure that continuous support is provided by the back support 110 for all variations in the shaping of the back support 110 to a user's back.

The continuously varying channel cross-section of an approximate isosceles trapezoid closely shapes and supports a user's back. A user's back is typically curved in the vertical or dorsal direction and approximated in the transverse or lateral direction by a flat section transversely across the back with curved sides to the abdomen or chest. In other words the three dimensional shape of a user's back is supported by a three dimensional isosceles trapezoidal channel back support. In a transverse section across the back the flat section of the back is supported by the base of the isosceles trapezoid corresponding to the flat portion of the horizontal band, whilst the sides of the trapezoid correspond to the sloping sides of the horizontal bands supporting the sides of the user's back.

Continuous support for a user's back is particularly important to reduce isolated back muscle activity and consequently the fatigue that is associated with prolonged sitting common in modern offices and other working environments. Lack of continuous physical support transversely/laterally across and up the user's back may result in muscle groups, such as for example the latissimus dorsi and erector spinae (or sacrospinalis), being isolated and fatigued.

Another advantage of the continuous back support transversely across as well as up the back of the user is that if the user reclines the back support 110 in relation to the seat, adequate support is still given to the user's back. The back support 110 may provide adequate support as the back support 110 is reclined from 90° to 105° or 90° to 110° or more from the seat plane (or 15° or more from the vertical). A greater reclining angle may be possible depending on the user for example approximately 105° to 125°. For some users it is beneficial to periodically lean against and move the backrest to recline backwards to enable some stretching about the sacral (hips) and lumbar regions (at least). Part of the stretching may also involve extending the lower limbs of the legs.

It will be readily appreciated that a minimal arrangement of the back support may have only two horizontal bands 114 with two vertical straps 116. This may correspond with providing back support to at least two of a sacral region (hip), a lumbar region (lower back), a thoracic region below the scapulae (middle of the back) and a cervical region including the scapulae (shoulder blades) of a user. It will also be readily appreciated that more than four horizontal bands with two overlaying vertical straps may also be used to provide a more adjustable back support as described herein. The arrangement of four horizontal bands 114 with the two overlaying vertical bands 116 is the preferred arrangement.

In another alternative to tailoring or customising the shape and level of support provided by the back support 110: one or more horizontal bands of the four may not be used. For example a horizontal band may be taken out of service by allowing to it to be slack with no appreciable tension. One example of a customising of shape is to adjust the free shoulder space felt by a user by either changing the tension in the topmost horizontal band 1114, taking the topmost horizontal band 1114 out of service and/or changing the separation between vertical straps 114 at their upper ends 310. Free shoulder space is defined in "*Free shoulder space requirements in the design of high backrests*" by Goossens et al, Ergonomics 2003, vol. 46, no. 5, pages 518-530, the contents of which are incorporated herein by reference. Free shoulder space is the free space for the scapulae and allows for relaxed prolonged sitting. It is also may be associated with movement about the shoulders when sitting.

The type of chair based work done by a user provides an example of the variation in free shoulder space and back support that may be required. For example office based work at a desk based computer may only require limited shoulder movement to allow for operation of a keyboard and access to papers on the desk. In contrast in a factory line industrial environment or a system/plant operator a large amount of shoulder movement may be required to access and operate items above, to the sides and below the chair user. Accordingly the free shoulder space needed about the scapulae may be high so the back support may need to be higher for the sacral, lumbar and thoracic below the scapulae (middle of the back) regions compared with the scapulae to cervical regions of a user's back.

In another example a topmost or bottom horizontal band 1114, 1110 may be taken out of service and then the nearest ends of the vertical straps to the disused horizontal band, secured in an adjacent slot of the frame. In such a manner users with smaller stature or requiring a smaller region of back support may customise the back support 110.

In the following an example is provided of how the back support 110 may be set up by an office worker for their use.

a) The vertical bands 116 may be pre-tensioned and set in location to the frame at the factory or local dealership/distribution hub. The factory setting of the tension and location of the vertical straps may be to an office work normal or set from height and build information supplied by the officer worker on ordering the chair or back support.

b) Adjust the back support to a comfortable height. This is usually done by a conventional adjustment mechanism below the back support.

c) Whilst sitting in the seat at a preferred angle of approximately 105° to 110° have a colleague adjust the tension in the horizontal bands to obtain a comfortable level of support as well as conformal fitting to the back. The lower horizontal bands may be adjusted to support the sacral and lumbar regions for sufficient support. The upper horizontal bands may be adjusted for the middle of the back to the scapulae—cervical region to obtain sufficient shoulder free space with support to the middle of the back. Free shoulder space may be judged by a comfortably supported freedom to move in the shoulder region of the user, that is the scapulae-cervical region of the back.

d) Re-visit steps (b) and (c) after sitting in the chair for some hours.

Adjusting the back support 110 for a particular user is largely intuitive. The level and location of the back support 110 for a user may be adjusted during the course of a day to accommodate for different use of the back support by the user. Different uses of the back support include the user chair based work tasks and fatigue level. In addition the level and location of the back support 100 may be adjusted to accommodate any muscular, skeletal or medical conditions that the user may have. It will be readily appreciated that other methods may be used for different versions of the back support for adjustability. For example further access to the back support 110 may be provided so that the vertical straps 116 may be adjusted to tension and securing location in the frame 112.

Figure 12:
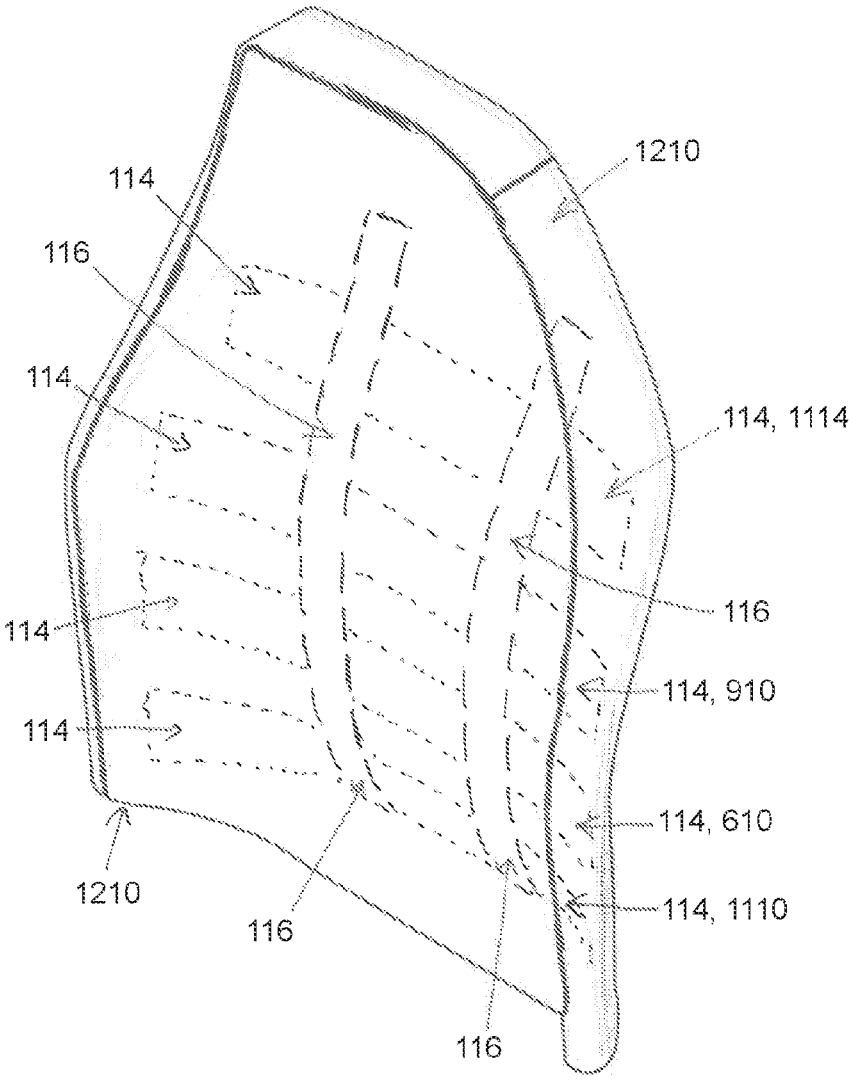
FIGS. 12 and 13 are schematics of respective front and rear perspective views of the back support with upholstery and a cover applied.
Figure 13:
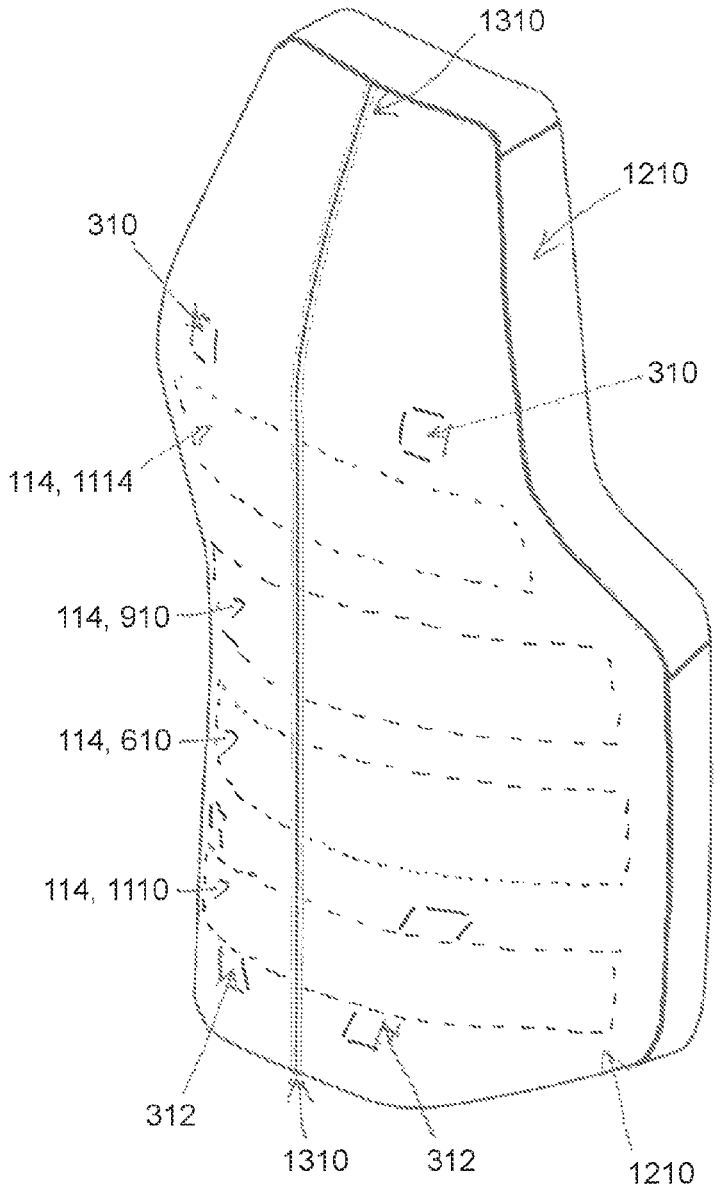

In FIGS. 12 and 13 are respective front and rear perspective views of the back support 110 with upholstery and a cover applied. In the FIGURES the outline of the cover 1210 is shown in continuous lines whilst the vertical straps 116 are shown in long dashed lines and the horizontal bands 114 are shown in short dashed lines. The back support 110 may be covered in a foam layer with a fabric cover. Alternatively or in addition the foam may be substituted with multiple fabric layers, a mesh, a knitted textile or a polymer material. A person skilled in the art of upholstery may select the coverings in order to not impede in the functioning of the invention. FIG. 13 also shows a dorsal zipper 1310 on the rear of the cover 1210. The zipper 1310 allows the user to access the adjustable Velcro or buckle 320 for adjusting the individual tensions in the horizontal bands 114. If a fabric cover is not used then a zipper may not be necessary, accordingly the rear of the back support 110 may be exposed as a feature.

It will be readily appreciated that the pre-production form of the frame shown in the FIGURES is one example of a frame suitable for use. Other versions of the frame may be used to support and secure the vertical straps overlaying the horizontal straps as described herein. For example alternate versions of the frame may be used as suitable for the factory environment and to suit a wheelchair.

It will be readily appreciated that the back support may be available as a stand-alone product or retrofitted to an existing seat or chair. For example as an insert to an existing chair back or replacing the back rest entirely with the back support 110 of the invention.

The T-brace or otherwise connection between the back support 110, the seat and the rest of the chair structure (e.g. arm rests, legs, etc.) may be flexibly connected to allow for vertical height adjustment as well as changing the reclining angle from the vertical in the usual manner. For example the vertical adjustment may be by a ratchet or otherwise adjuster for the back support height with respect to the seat of the chair. The reclining angle from the vertical may also be moveable rather than fixed.

The T-Brace may also have an attachment fixture for an optional headrest module. The T-Brace may also have a device to allow for an optional coat-hanger to be attached.

Further advantages to the back support 110 invention are as follows. The back support 110 described herein provides tailored back support to users who may vary in age, gender, musculature, build and general health. The back support 110 shape and stiffness of support may be varied depending on the intensity, period and type of chair based work as well as to support and aid in the treatment of a medical condition.

It will be appreciated that the invention may embodied in other forms, such as, for example, wherein the horizontal bands are replaced with other deformable members and/or wherein the vertical straps are securely fixed to the underside of the bands, or threaded through them, rather than overlaying them.

It will thus be appreciated that, broadly speaking, embodiments of the present invention provide a seat back support with an adjustable support curvature (or support profile) as now described. The seat back support typically includes a frame and at least one elongate deformable member extending between side portions of the frame. The deformable member may, for example, be an elasticized band or section of compressible material. In any case, an elongate adjustment element intersects one or more of the at least one deformable member(s). Manipulation of the adjustment element adjusts the deformation of the one or more deformable member(s) with which it intersects to adjust the curvature (or support profile) of the back support. The elongate adjustment element may, in one example, be a strap or the like.

Typically, the adjustment element is manipulated so as to extend between different points in the frame so as to adjust the amount and/or location of deforming engagement with the deformable member(s). When embodied as a strap or the like, manipulation may also be carried out by adjusting the tension thereof.

Generally, the back support includes a plurality of elongate deformable members and the elongate adjustment element intersects all the elongate deformable members. For example, the adjustment element may extend between a top portion of the frame, above the at least one deformable element, and a bottom portion of the frame, below the at least one deformable element.

In typical examples the plurality of elongate deformable members (e.g. elasticized bands) do not intersect one another and are substantially parallel, although this may not always be the case.

It will also be appreciated that the back support may include a plurality adjustment elements (e.g. straps). Each adjustment element may, for example, be located so as to intersect a different subset of the deformable members. Different adjustment elements may also be located so as to intersect deformable elements at different locations or angles.

In some cases, the at least one elongate deformable member may be suspended between the side portions of the frame. For example, when embodied as suspended bands, this permits deformation to increase concavity in the support curvature. If, for example, the bands were not suspended, and held adjacent the frame, they may not have the free space to deform in the direction of the frame i.e. to provide concavity in the support curvature.

It will also be appreciated that, to allow for deformation of the elongate deformable member(s), the adjustment element(s) typically have some engagement (e.g. contacting engagement) with the deformable member(s) at the points of intersection therewith, either directly or indirectly.

In this specification, terms denoting direction, such as vertical, up, down, left, right etc. or rotation, should be taken to refer to the directions or rotations relative to the corresponding drawing rather than to absolute directions or rotations unless the context require otherwise.

Although the invention has been herein shown and described in what is conceived to be the most practical and preferred embodiments, it is recognized that departures can be made within the scope of the invention, which are not to be limited to the details described herein but are to be accorded the full scope of the appended claims so as to embrace any and all equivalent assemblies, devices, apparatus, articles, compositions, methods, processes and techniques.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise, comprised and comprises" where they appear.

It will further be understood that any reference herein to known prior art does not, unless the contrary indication appears, constitute an admission that such prior art is commonly known by those skilled in the art to which the invention relates.

The invention claimed is:

1. A seat back support comprising:

a frame;

a plurality of substantially parallel and substantially horizontal elasticized bands suspended between side portions of the frame; and two substantially parallel and substantially vertical elasticized straps extending between a top portion and a bottom portion of the frame, the vertical straps contacting and intersecting the horizontal bands, wherein the vertical straps are spaced apart from one another and are configured to deform the horizontal bands so that they provide a rear flat portion that extends between the vertical straps, and forward sloping side portions that extend from the vertical straps to the side portions of the frame, and wherein the vertical straps are adjustable in tension.

2. A seat back support according to claim 1, wherein the vertical straps overlay the horizontal bands.

3. A seat back support according to claim 1, wherein the horizontal bands are deformed to define a substantially vertical channel with a substantially trapezoidal cross section.

4. A seat back support according to claim 1, wherein the vertical straps have a lesser width than the horizontal bands.

5. A seat back support according to claim 1, wherein the horizontal bands are adjustable in tension.

6. A seat back support comprising:

a frame;

a plurality of substantially parallel and substantially horizontal elasticized bands suspended between side portions of the frame; and two substantially parallel and substantially vertical elasticized straps extending between a top portion and a bottom portion of the frame, the vertical straps contacting and intersecting the horizontal bands, wherein the vertical straps are spaced apart from one another and are configured to deform the horizontal bands so that they provide a rear flat portion that extends between the vertical straps, and forward sloping side portions that extend from the vertical straps to the side portions of the frame, and wherein the frame includes a plurality of vertically spaced apertures, wherein each of the vertical straps is received through a pair of apertures, one upper and one lower, to define the length of extension thereof, between the top to the bottom portion of the frame.

7. A chair including a seat back support according to claim 6.

8. A seat back support according to claim 6, wherein the vertically spaced apertures are horizontal slots, and the vertical straps are selectively locatable within the slots to adjust the separation therebetween.

9. A seat back support according to claim 6, wherein the vertical straps are selectively receivable through different pairs of apertures, to set different lengths of extension thereof, between the top and bottom portion of the frame.

10. An office A chair including a seat back support according to claim 1.

11. A seat back support comprising:

a frame;

at least two substantially parallel and substantially horizontal elastically deformable bands suspended between side portions of the frame; and two substantially parallel and substantially vertical elastically deformable straps extending between a top portion and a bottom portion of the frame, the vertical straps contacting and intersecting the horizontal bands, wherein the vertical straps are spaced apart from one another and are configured to deform the horizontal bands so that they provide a rear central flat portion and forward sloping side portions, wherein the vertical straps have a lesser width than the horizontal bands, and wherein the horizontal bands are deformed to define a substantially vertical channel with a substantially trapezoidal cross section.

12. A chair including a seat back support according to claim 11.

13. A seat back support comprising:

a frame;

at least two substantially parallel and substantially horizontal elastically deformable bands suspended between side portions of the frame; and two substantially parallel and substantially vertical elastically deformable straps extending between a top portion and a bottom portion of the frame, the vertical straps contacting and intersecting the horizontal bands, wherein the vertical straps are spaced apart from one another and are configured to deform the horizontal bands so that they provide a rear central flat portion and forward sloping side portions, and wherein the frame includes a plurality of vertically spaced apertures, wherein each of the vertical straps is received through a pair of apertures, one upper and one lower, to define the length of extension thereof, between the top to the bottom portion of the frame.

14. A chair including a seat back support according to claim 13.

15. A seat back support according to claim 13, wherein the vertical straps overlay the horizontal bands.

16. A seat back support according to claim 13, wherein the horizontal bands are deformed to define a substantially vertical channel with a substantially trapezoidal cross section.

17. A seat back support according to claim 13, wherein the vertically spaced apertures are horizontal slots, and the vertical straps are selectively locatable within the slots to adjust the separation therebetween.

18. A seat back support according to claim 13, wherein the vertical straps are selectively receivable through different pairs of apertures, to set different lengths of extension thereof, between the top and bottom portion of the frame.

* * * * *